US006551081B2

(12) United States Patent
Nakane et al.

(10) Patent No.: US 6,551,081 B2
(45) Date of Patent: Apr. 22, 2003

(54) SCROLL-TYPE COMPRESSOR FOR A FUEL CELL WITH AN OBSTRUCTION MEMBER AROUND A DRIVE SHAFT

(75) Inventors: Yoshiyuki Nakane, Kariya (JP); Masato Sowa, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/068,715

(22) Filed: Feb. 6, 2002

(65) Prior Publication Data

US 2002/0106294 A1 Aug. 8, 2002

(30) Foreign Application Priority Data

Feb. 8, 2001 (JP) ..... 2001-031999

(51) Int. Cl.[7] ..... F01C 1/04; F01C 19/00

(52) U.S. Cl. ..... 418/55.2; 418/55.4; 418/60; 418/104; 417/374

(58) Field of Search ..... 418/55.2, 55.4, 418/60, 104; 417/374, 406

(56) References Cited

U.S. PATENT DOCUMENTS 5,616,015 A * 4/1997 Liepert ..... 418/60

FOREIGN PATENT DOCUMENTS

DE 3826640 * 3/1989 ..... 418/60
JP 2000-156237 6/2000

* cited by examiner

*Primary Examiner*—John J. Vrablik
(74) *Attorney, Agent, or Firm*—Woodcock Washburn LLP

(57) ABSTRACT

A scroll-type compressor for a fuel cell 1 of the present invention comprises: a fixed scroll for compression 31; a movable scroll for compression 61; a movable plate 6, which has the movable scroll for compression 61 erected on the surface thereof and a shaft insertion portion 60 into which a drive shaft 5 is inserted; a bearing 7, which is provided inside the shaft insertion portion 60 and supports the drive shaft 5 with a lubricant; a fixed scroll for expansion 41; and a movable scroll for expansion 62; and comprises a seal member 8 that prevents the lubricant from leaking and an obstruction member 51 that is provided between the seal member 8 and the inflow port 43 to change the direction of passage of the gas that flows in through the inflow port 43.

3 Claims, 3 Drawing Sheets

SCROLL-TYPE COMPRESSOR FOR A FUEL CELL WITH AN OBSTRUCTION MEMBER AROUND A DRIVE SHAFT

BACKGROUND OF THE INVENTION

1. Field of the Invention

The present invention relates to a scroll-type compressor for a fuel cell. More particularly, the present invention relates to a scroll-type compressor that makes an exhausted gas from the fuel cell flow in again to additionally support the driving power of the compressor.

2. Description of the Related Art

Recently, a fuel cell has begun to attract attention as a drive source for electric cars. In a fuel cell, oxygen and hydrogen, compressed in advance by a compressor, are made to react to generate electricity. Water produced in the reaction, and a gas from which oxygen and hydrogen have been consumed is exhausted.

In most cases, the gas exhausted from the fuel cell maintains a state of high pressure. A scroll-type compressor equipped with a regeneration mechanism, which utilizes the energy produced by the expansion of the exhausted gas in the state of high pressure to additionally support the driving power of the compressor, has been disclosed in Japanese Unexamined Patent Publication (Kokai) No.2000-156237.

FIG. 4 is an axial cross-sectional view of the scroll-type compressor 100 with a regeneration mechanism. A housing 101 is the outer shell of the scroll-type compressor 100. On a discharge side inner surface 102 of the housing 101, a fixed scroll for compression 103 is erected in the direction of the motor. On a motor-side inner surface 104, which opposes the discharge side inner surface 102, a fixed scroll for expansion 105 is erected in the direction of discharge. Between these two fixed scrolls, a movable plate 106, equipped with a shaft insertion portion 114 that opens toward the motor side in the center of the inner circumferential side, is provided.

On the inner circumferential side of the shaft insertion portion 114, a bearing 115 to which a lubricant has been applied and two ring-seal members 117 that enclose the lubricant are provided. Moreover, into the further inner circumferential side of the bearing 115, a crank-shaped drive shaft 110 is rotatably inserted.

On the discharge side surface of the movable plate 106, a movable scroll for compression 107 is erected and on the motor-side surface of the movable plate 106, a movable scroll for expansion 108 is erected. A compression chamber 111 is defined by the fixed scroll for compression 103 and the movable scroll for compression 107. Moreover, a suction port 120 is formed on the outermost circumferential portion of the compression chamber 111 and a discharge port 121 is formed in the central portion of the inner circumferential side thereof, respectively.

On the other hand, an expansion chamber 112 is defined between the fixed scroll for expansion 105 and the movable scroll for expansion 108. Moreover, an inflow port 130 is formed in the central portion of the inner circumferential side of the expansion chamber 112 and an outflow port 131 is formed on the outermost circumferential portion thereof, respectively.

On the outer circumferential portion of the movable plate 106, a self-rotation preventing shaft 113 that prevents the self-rotation of the movable plate 106 is provided.

When the motor causes the drive shaft 110 to rotate and the movable scroll for compression 107 revolves, the air to be supplied to the fuel cell is sucked into the compression chamber 111 through the suction port 120 and moves toward the central side of the fixed scroll for compression 103 while being compressed. The compressed air is supplied to the fuel cell through the discharge port 121. The air, the oxygen of which has been consumed in the reaction in the fuel cell, is exhausted from the fuel cell as an exhaust gas. Then the exhaust gas flows again into the inside of the expansion chamber 112 through the inflow port 130 and moves toward the outer circumferential side of the fixed scroll for expansion 105 while expanding. At this time, the expansion energy of the exhaust gas is converted into the drive energy of the drive shaft 110. The expanded exhaust gas is exhausted to the outside of the compressor 100 through the outflow port 131.

In such a conventional scroll-type compressor for a fuel cell, however, the exhaust gas of the fuel cell directly hits the seal member 117 when the exhaust gas flows into the inside of the expansion chamber 112 through the inflow port 130. The exhaust gas contains water produced in the reaction in the fuel cell. On the other hand, the seal member 117 is provided in order to prevent the leakage of the lubricant from the bearing 115, as described above. However, since the physical characteristic, such as the viscosity, of water differs from lubricant, it is difficult to prevent the water contained in the exhaust gas from entering by the seal member 117. Therefore, in the conventional scroll-type compressor the lubricant is degraded due to the water that has entered the bearing 115.

In this case, it seems to be possible to suppress the degradation of lubricant by decreasing the flow speed of the exhaust gas, that is, by decreasing the flow rate, to prevent water from entering. But, if the flow rate is reduced, the effect to additionally support the driving power of the compressor with the aid of the expansion energy of the compressed exhaust gas is also reduced.

SUMMARY OF THE INVENTION

The present invention has been developed and completed with the above-mentioned problems being taken into account, and the object is to provide a scroll-type compressor for a fuel cell that can prevent the water contained in the exhaust gas from entering the inside of the bearing and prevent the degradation of lubricant without decreasing the flow rate of the exhaust gas.

In order to solve the above-mentioned problems, the scroll-type compressor for a fuel cell of the present invention comprises: a fixed scroll for compression; a movable scroll for compression that defines a compression chamber, between the movable scroll for compression and the fixed scroll for compression, in which a gas sucked from the outer circumferential side is compressed by moving the gas in the direction of the inner circumference; a movable plate that has the movable scroll for compression erected on a first surface thereof and a cup-shaped cylindrical shaft insertion portion, which opens toward a second surface reverse to the first surface near the center and into which a drive shaft is inserted; a bearing that is provided inside the shaft insertion portion and supports the drive shaft with a lubricant therein; a fixed scroll for expansion provided in such a way as to oppose the second surface of the movable plate; a movable scroll for expansion that is erected on the second surface of the movable plate and defines an expansion chamber, between the movable scroll for expansion and the fixed scroll for expansion, in which the gas, which has flowed in through the inflow port formed near the center of the inner circumferential side, is expanded by moving the gas in the direction of the outer circumference; wherein the compressor also comprises a seal member that prevent the leakage of the lubricant through the opening end of the shaft insertion portion, and an obstruction member provided between the seal member and the inflow port to prevent water, contained in the gas, from entering the bearing within the shaft insertion portion by changing the flow of the gas, containing the water, that flows in through the inflow port.

In other words, the scroll-type compressor for the fuel cell of the present invention provides the obstruction member, that prevents the water contained in the exhaust gas from entering the bearing, in addition to the seal member. Conventionally, the exhaust gas flowing in through the inflow port directly hits the seal member and the water contained in the gas enters the inside of the bearing. In other words, no obstacle exists, that blocks the passage of the exhaust gas, between the inflow port and the seal member.

The scroll-type compressor for a fuel cell of the present invention newly provides the obstruction member that blocks the passage of the exhaust gas. If the obstruction member is provided, the flowing direction of the exhaust gas can be changed and it is possible to prevent the exhaust gas flow from directly hitting the seal member. In this way, it is possible to prevent the water contained in the exhaust gas from entering the inside of the bearing and to prevent the lubricant from degrading.

The present invention may be more fully understood from the description of the preferred embodiments of the invention set forth below, together with the accompanying drawings.

DESCRIPTION OF THE PREFERRED EMBODIMENTS

The embodiments of the scroll-type compressor of the present invention are described below.

<First Embodiment>

Figure 1:
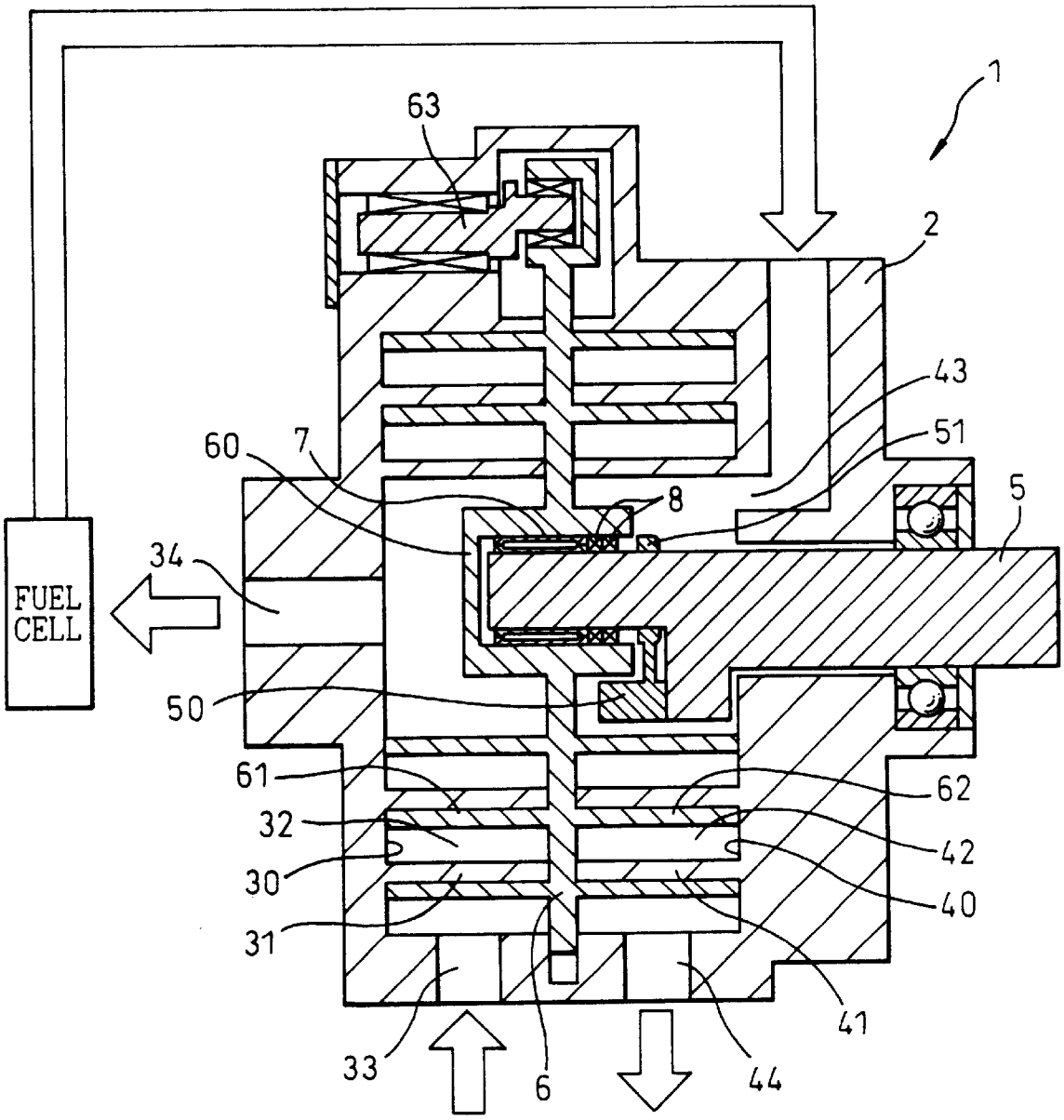
FIG. 1 is an axial sectional view of the scroll-type compressor of the present invention.

FIG. 1 is an axial sectional view of a scroll-type compressor 1 for a fuel cell in the first embodiment. The scroll-type compressor 1 in the present embodiment is driven by a motor that is not shown in the figure. The gas to be compressed in the scroll-type compressor 1 in the present embodiment is air, which is supplied to a fuel cell as an oxidant.

A housing 2 is cylindrical and is the outer shell of the scroll-type compressor 1 in the present embodiment. Within the housing 2, a scroll-shaped fixed scroll for compression 31 is erected on a discharge side inner surface 30 toward the direction of the motor. On the other hand, a scroll-shaped fixed scroll for expansion 41 is erected on a motor side inner surface 40, which opposes the discharge side inner surface 30, toward the direction of discharge. Between these two fixed scrolls, a disc-shaped movable plate 6, which has a shaft insertion portion 60 that opens toward the direction of the motor in the center of the inner circumferential side, is interposed.

Figure 2:
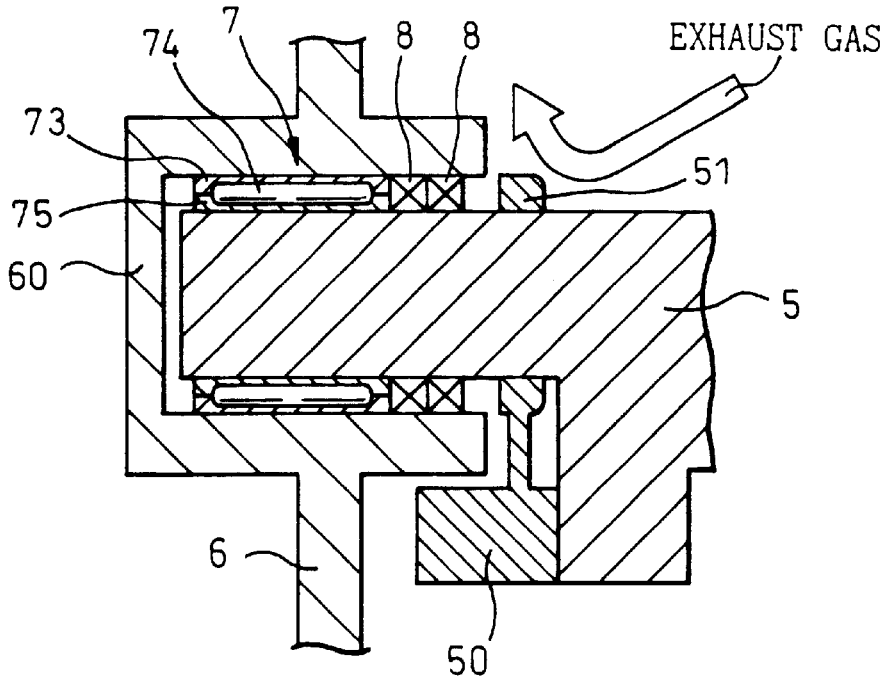
FIG. 2 is an enlarged view in the vicinity of the bearing of the scroll-type compressor in the first embodiment of the present invention.

On the inner circumferential side of the shaft insertion portion 60, a bearing 7 and a seal member 8 are provided. As shown in FIG. 2, the bearing 7 comprises an outer ring 73, rollers 74, and an inner ring 75. The outer ring 73 is cylindrical and arranged in such a way as to come into contact with the inner circumferential wall of the shaft insertion portion 60. The roller 74 is circular column-shaped and plural rollers are arranged along the inner circumferential side of the outer ring 73. The inner ring 75 is cylindrical and arranged on the further inner circumferential side of the rollers 74 in such a way as to sandwich the rollers 74 between the outer ring 73 and the inner ring 75. A lubricant is applied to the bearing 7 to reduce abrasion between the roller 74 and the outer ring 73, and between the roller 74 and the inner ring 75.

The ring seal member 8 is formed of a PTFE-based resin. Two of the seal members 8 are provided at the opening end of the shaft insertion portion 60 to prevent the lubricant applied to the bearing 7 from leaking through the opening end.

Into the still further inner circumferential side of the inner ring 75 of the bearing 7, a drive shaft 5, one end of which is connected to a motor rotation shaft (not shown), is rotatably inserted. Around the motor side of the insertion portion of the drive shaft 5, a ring collar 51 formed integrally with a balance weight 50 is arranged. In other words, in the vicinity of the bearing 7, the bearing 7, the seal member 8, and the collar 51 are arranged in this order in the axial direction from the discharge side.

On the discharge side surface of the movable plate 6, a movable scroll for compression 61 is erected in such a way as to engage with the fixed scroll for compression 31. Between the discharge side inner surface 30 of the housing 2 and the discharge side surface of the movable plate 6, a compression chamber 32 is defined by the fixed scroll for compression 31 and the movable scroll for compression 61. A suction port 33 is formed on the outermost circumferential portion of the compression chamber 32 and a discharge port 34 is formed in the central portion of the inner circumferential side thereof, respectively.

On the other hand, on the motor side surface of the movable plate 6, a movable scroll for expansion 62 is erected in such a way as to engage with the fixed scroll for expansion 41. Between the motor side inner surface 40 and the motor side surface of the movable plate 6, an expansion chamber 42 is defined by the fixed scroll for expansion 41 and the movable scroll for expansion 62. An inflow port 43 that opens toward the seal member 8 is formed in the central portion of the inner circumferential side of the expansion chamber 42, and an outflow port 44 is formed on the outermost circumferential portion, respectively.

Moreover, on the outer circumferential portion of the movable plate 6, a self-rotation preventing shaft 63 that prevents the self-rotation of the movable plate 6 is provided.

When the motor causes the drive shaft 5 to rotate and the movable plate 6 revolves, the movable scroll for compression 61 revolves and air is sucked into the compression chamber 32 through the suction port 33. The air moves toward the center of the inner circumference side of the fixed scroll for compression 31 while being compressed. The compressed air is supplied to the fuel cell through the discharge port 34. The air, the oxygen of which has been consumed in the reaction in the fuel cell, is exhausted from the fuel cell as an exhaust gas and flows again into the expansion chamber 42 through the inflow port 43.

Between the inflow port 43 and the seal member 8, the collar 51 intervenes. Since the direction of passage of the exhaust gas is changed by the collar 51, it does not happen that the exhaust gas directly hits the seal member 8. Therefore, it is possible to prevent the water contained in the exhaust gas from entering the bearing 7.

The exhaust gas, the direction of passage of which has been changed, moves toward the outer circumferential side of the fixed scroll for expansion 41 while expanding in the expansion chamber 42. The expanded gas is exhausted to the outside of the compressor 1 through the outflow port 44.

The collar 51, which is the obstruction member in the present embodiment, is manufactured integrally with the balance weight 50 as described above. The collar 51 is provided around the outer circumferential surface of the drive shaft 5 by passing the drive shaft 5 through the inner circumferential side of the collar 51 when the balance weight 50 is fixed to the drive shaft 5.

The diameter, the angle etc. of the collar can be determined adequately, the arrangement of the inflow port, the direction of the air flow, and so on, being taken into account.

<Second Embodiment>

Figure 3:
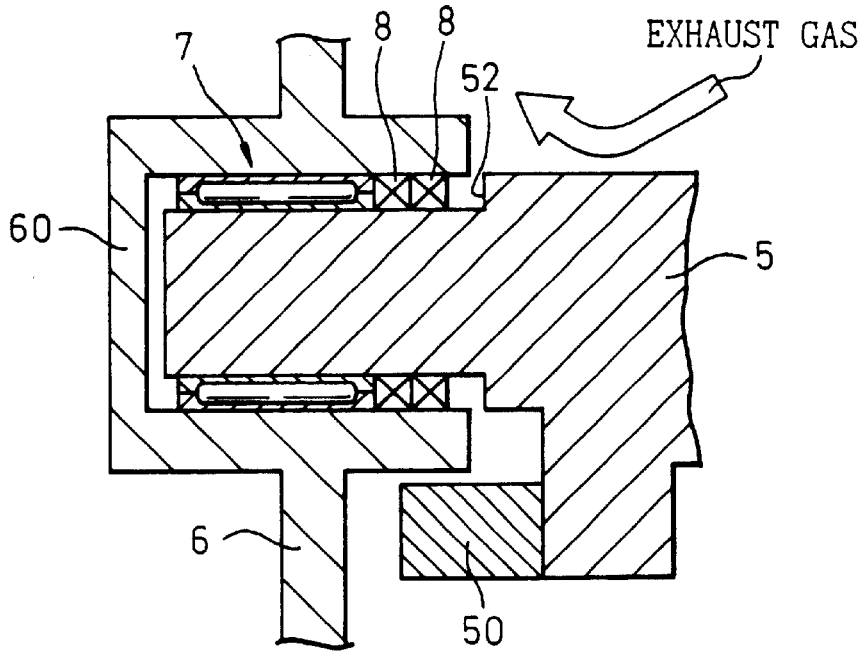
FIG. 3 is an enlarged view in the vicinity of the bearing of the scroll-type compressor in the second embodiment of the present invention.
Figure 4:
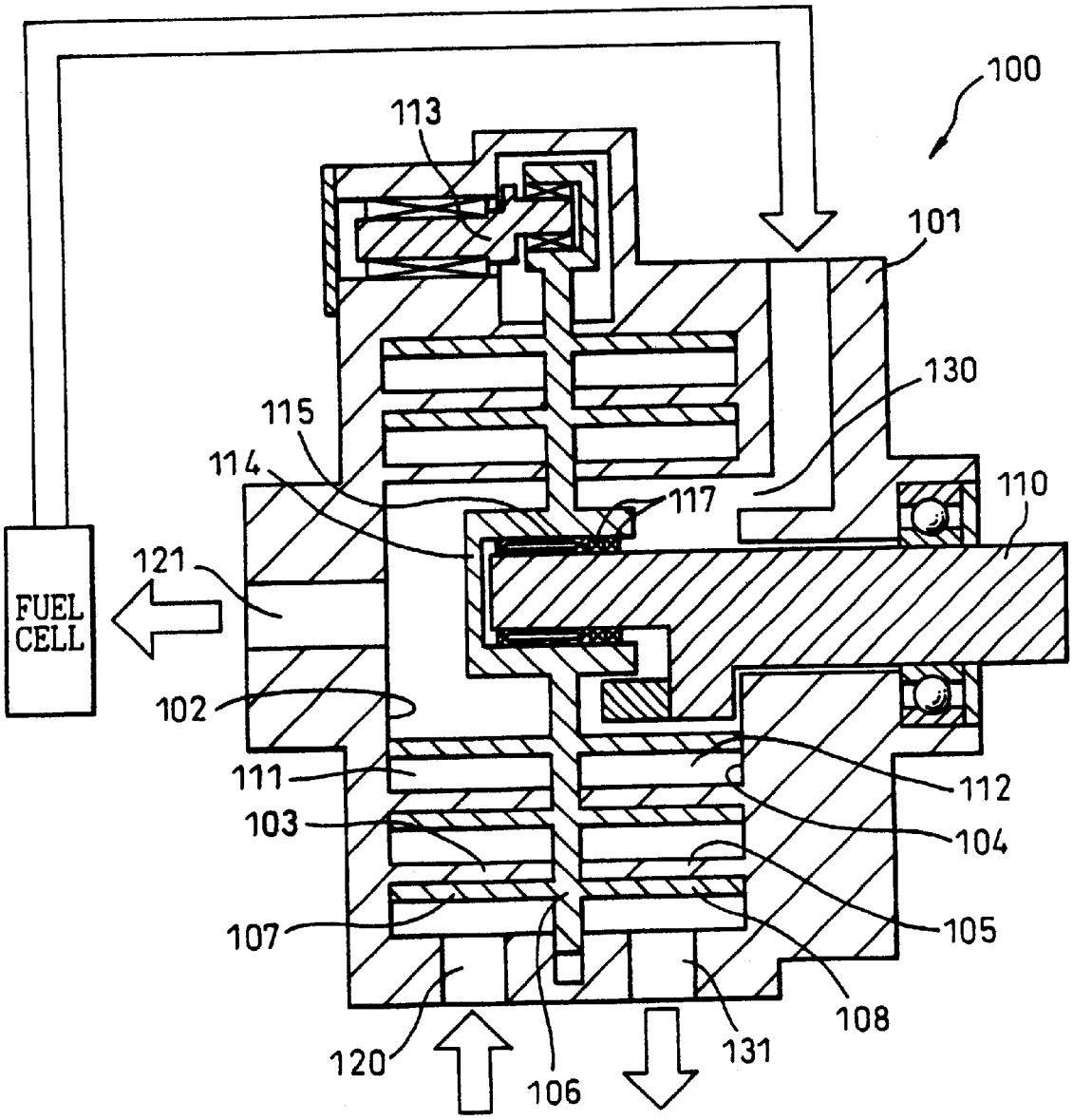
Fig. 4 Prior Art
FIG. 4 is an axial sectional view of a conventional scroll-type compressor.

In the scroll-type compressor in the present embodiment, a step is formed in the drive shaft as an obstruction member. FIG. 3 shows an enlarged view in the vicinity of the bearing 7 of the scroll-type compressor 1 in the present embodiment. The same symbols are used for the members corresponding to those in the first embodiment.

A step 52 is formed in such a way as to decrease the diameter of the drive shaft 5 toward the discharge direction and is arranged near the opening end of the shaft insertion portion 60. In other words, the step 52 intervenes between the inflow port 43 and the seal member 8. The exhaust gas that flows in through the inflow port 43 changes direction by hitting the step 52. Therefore, it is possible to prevent the water contained in the exhaust gas from entering the inside of the bearing 7. The step 52 is formed integrally when the drive shaft 5 is made by casting.

Although the embodiments of the scroll-type compressor of the present invention are described above, the embodiments of the scroll-type compressor of the present invention are not restricted to those described above. Various modifications or applied embodiments are possible to those skilled in the art.

Particularly, it should be understood that the invention may be embodied in the following forms.

It is also possible to provide another obstruction member on the inflow port side of the collar 51. In other words, plural obstruction members may be provided. For example, it is possible to provide a structure in which a ring erected on the inner circumferential wall of the shaft insertion portion 60 is provided in the inflow port side of the collar 51. In such a structure, the water contained in the gas can be further prevented from entering the bearing 7 because the passage of the exhaust gas to the bearing 7 becomes complicated.

Although a sliding bearing or a rolling bearing can be used as the bearing 7, it is preferable to use a rolling bearing because the friction thereof is less. When a rolling bearing is used, it is applicable to arrange rolling bodies such as balls or rollers in two or more arrays in the axial direction.

As a seal member, a rubber ring, a plastic ring, a felt ring, and so on, can be used. The position at which the seal member is provided is not restricted. For example, it is possible to provide a seal member directly between the inner circumferential wall of the shaft insertion portion 60 and the outer circumferential surface of the drive shaft 5, separately from the bearing 7, as shown in FIG. 1. It is also possible to provide a seal member between the outer ring 73 and the inner ring 75, integrally with the bearing 7. The number of the seal members may be one or more.

As for the lubricant, a mineral oil or a synthetic hydrocarbon can be used as a base element and a grease that uses a lithium soap or poly-urea can be used as a thickener.

The scroll-type compressor for a fuel cell of the present invention is used to supply oxygen or air, which is an oxidant gas, and hydrogen, which is a fuel gas.

According to the scroll-type compressor of the present invention, it is possible to prevent the water contained in the exhaust gas of the fuel cell from entering the inside of the bearing and prevent the degradation of the lubricant.

While the invention has been described by reference to specific embodiments chosen for the purposes of illustration, it should be apparent that numerous modifications could be made thereto by those skilled in the art without departing from the basic concept and scope of the invention.

We claim:

1. A scroll-type compressor for a fuel cell, comprising:

a fixed scroll for compression;

a movable scroll for compression that defines a compression chamber, between the movable scroll for compression and the fixed scroll for compression, in which a gas sucked from the outer circumferential side is compressed by moving the gas in the direction of the inner circumference;

a movable plate that has the movable scroll for compression erected on a first surface thereof and a cup-shaped cylindrical shaft insertion portion, which opens toward a second surface reverse to the first surface near the center and into which a drive shaft is inserted;

a bearing that is provided inside the shaft insertion portion and supports the drive shaft with a lubricant therein;

a fixed scroll for expansion provided in such a way as to oppose the second surface of the movable plate;

a movable scroll for expansion that is erected on the second surface of the movable plate and defines an expansion chamber, between the movable scroll for expansion and the fixed scroll for expansion, in which the gas, that has flowed in through an inflow port formed near the center of the inner circumferential side, is expanded by moving the gas in the direction of the outer circumference;

wherein the compressor also comprises, a seal means for preventing the leakage of the lubricant through the opening end of the shaft insertion portion, and an obstruction member provided between the seal means and the inflow port to prevent water, contained in the gas, from entering the bearing within the shaft insertion portion by changing the flow of the gas, containing the water, that flows in through the inflow port.

2. A scroll-type compressor for a fuel cell, as set forth in claim 1, wherein the obstruction member is a collar provided around the outer circumferential surface of the drive shaft.

3. A scroll-type compressor for a fuel cell, as set forth in claim 1, wherein the obstruction member is a step integrally formed with the drive shaft.

* * * * *